United States Patent [19]

Edelson

[11] Patent Number: 4,985,952

[45] Date of Patent: Jan. 22, 1991

[54] FLEXIBLY HINGED CONVERTIBLE MATTRESS

[76] Inventor: Nathan Edelson, 526 Hickory St., Missoula, Mont. 59801

[21] Appl. No.: 528,705

[22] Filed: May 23, 1990

[51] Int. Cl.[5] ..... A47C 27/14; A47G 9/06

[52] U.S. Cl. ..... 5/465; 5/12.2; 5/420; 150/158

[58] Field of Search ..... 5/465, 420, 417, 448, 5/12 R; 150/158; D6/596

[56] References Cited

U.S. PATENT DOCUMENTS

D. 142,685 10/1945 Zinkel ..... 5/465

4,293,965 10/1981 Hrubec ..... 5/465

FOREIGN PATENT DOCUMENTS 562409 9/1923 France ..... 5/465

2009594A 6/1979 United Kingdom ..... 5/465

*Primary Examiner*—Alexander Grosz

[57] ABSTRACT

Four rectangular cushion sections are flexibly interconnected along certain of their top and bottom edges by three hinges. The resulting mattress-like article may be variously folded and unfolded to function as a bed, exercise mat, day couch, or ottoman, and can also be compactly stored.

4 Claims, 3 Drawing Sheets

FLEXIBLY HINGED CONVERTIBLE MATTRESS

FIELD OF THE INVENTION

This invention relates to mattresses; specifically to mattresses that employ flexibly hinged elements so that the shape of the mattress may be altered to serve the purpose of other types of furniture.

BACKGROUND OF THE INVENTION

As the size of dwellings continues to decline, it is regrettable that the bed, which in its two-person form can take up the greater part of an entire room, should function almost exclusively for night-time use.

Heretofore, convertible sofa-beds have been taught which also serve as couches during the day. However, such convertible couches tend to be large and bulky and can not be easily stored in a closet, should it be desired to use the space which they occupy for other purposes, such as healthful physical exercise.

The so-called Murphy bed, while freeing-up room space when it is withdrawn to its vertical storage position, still occupies considerable and valuable wall space and necessities costly cabinetry and a mechincal system which is subject to failure.

My invention overcomes all the above limitations which have heretofore characterized the convertible mattress art by providing a noval mattress which functions as a single or double bed, daytime couch, exercise mat, or ottoman, in which last configuration it may also be conveniently transported an compactly stored. Moreover, unlike a conventional "convertible sofa", my invention requires no bulky frame or other support members. What is more, it also provides considerable incentive for healthy physical activity such as yoga, tumbling, or aerobics., as well as offering a safe and inviting play surface for children and infants.

The considerable versatility of my flexibly hinged convertible mattress enables a single room to be used for many purposes, while increasing the space, health, comfort and personal control of its users. I believe, therefore, that this invention may well become a standard object of modern domestic equipment, augmenting my other floor-based furniture innovations such as the Multi-Positional Support Device, Patent Pending Ser. No. 07/427,347, and related articles.

SUMMARY OF THE INVENTION

Four approximately rectangular pads of approximately the same length, width and height are interconnected in a novel way which permits their folding and unfolding to produce a double bed, exercise mat, single bed, couch, ottoman, and compact transport and storage module, at the discretion of the user.

Imagining a single rectangular mattress subdivided into four equal rectangular sections, let the top left section be "A," the bottom left section be "B," the bottom right section be "C," and the top right section be "D."

Then my flexibly hinged convertible mattress may be described as follows: Section A is flexibly attached to Section B along the top edges of A and B; Section D is flexibly attached to Section C along the top edges of D and C; and attached-sections AB and attached-sections DC are flexibly connected to each other along the inwardly-facing bottom edges of sections B and C.

The precise reasons for this novel joining arrangement will become evident in the following drawings and descriptions.

DESCRIPTION OF THE PREFERRED EMBODIMENT

Figure 1:
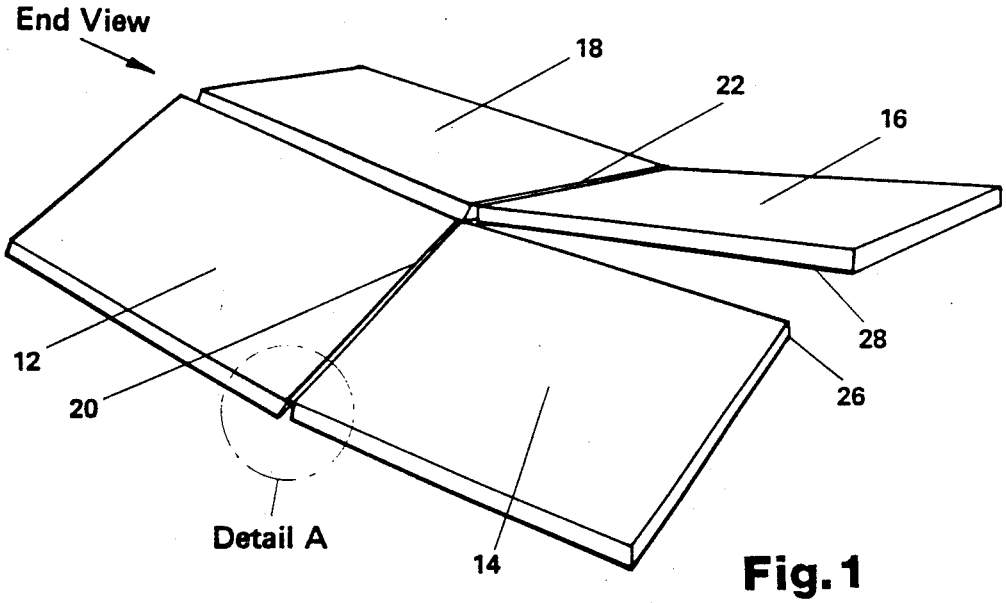
FIG. 1 is a perspective view of the flexibly hinged convertible mattress in a partially open position showing the hinges connecting the top edges of the component mattress pads.
Figure 1A:
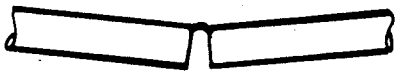
FIG. 1A is a side view detail of the hinge connecting the top edges of the component mattress pads
Figure 2:
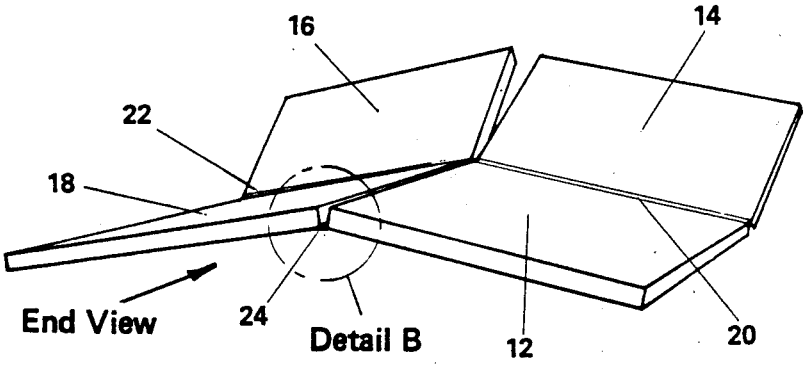
FIG. 2 is a perspective end-view of the mattress showing the hinge connecting the bottom edges of the component mattress pads.
Figure 2A:
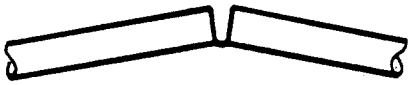
FIG. 2A is a side-view detail of the hinge connecting the bottom edges of the component mattress pads.

FIGS. 1 and 2 show the flexibly hinged covertible mattress in a semi-fully open position. The mattress includes four approximately rectangular pads 12, 14, 16, 18 interconnected by flexible hinges hinges 20, 22 and 24. Flexible hinge 20 connects along the top like-length edges of pads 12 and 14, and flexible hinge 22 connects along the top like-length edges of pads 16 and 18. These connections are shown on an expanded scale in Detail A.

Referring to FIG. 2, it will be noted that attached-pads 12 and 14 are connected with attached-pads 16 and 18 via flexible hinge 24, which runs along the like-length inner bottom edges of pads 12 and 18, and is shown on an expanded scale in Detail B. These bottom edges are those at right angles to the top edges joined by flexible hinges 20 and 22, and not necessarily of the same length as those top edges.

Referring to FIG. 1, it will be noted that there is no flexible connection along bottom inner like-length edges 26 and 28 of pads 14 and 16; this is to permit the mattress to the folded in a wide variety of useful positions, to be explained below.

Figure 3:
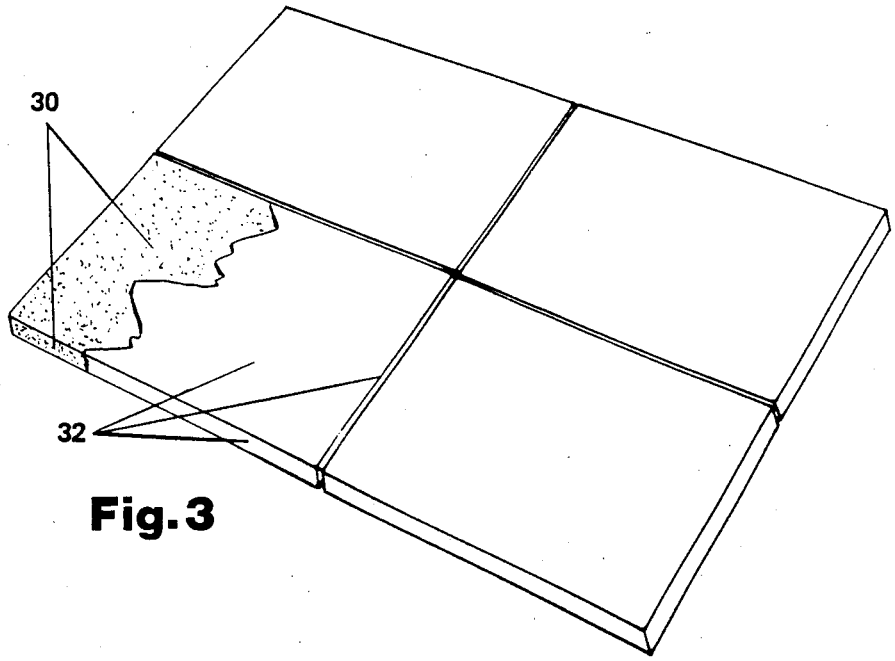
FIG. 3 is a perspective view of the mattress in a fully open position, as it would be used for two-person sleeping or exercise.

Referring now to FIG. 3, the flexibly hinged convertible mattress is shown fully open as it would be used as a double-sleeping bed or exercise mat. In a preferred embodiment the four pads are made of closed-cell plastic foam 30 covered with fabric covers 32. However, if a softer surface is desired, a separate overpad of open-cell urethane foam or other material may be constructed in the same general manner as the novel mattress herein described, so that when the overpad is placed upon the primary mattress in any configuration it will conform thereto.

The mattress pads or overpads may alternatively be made of a variety of other materials, such as vinyl covered closed-cell foam with integral molded hinges, combined closed-cell and open cell foams, and cotton, wool, synthetic fibers, kapok, or combinations thereof, contained by fabric membranes. It is not required that the mattress pads have right-angle edges or corners.

Figure 4:
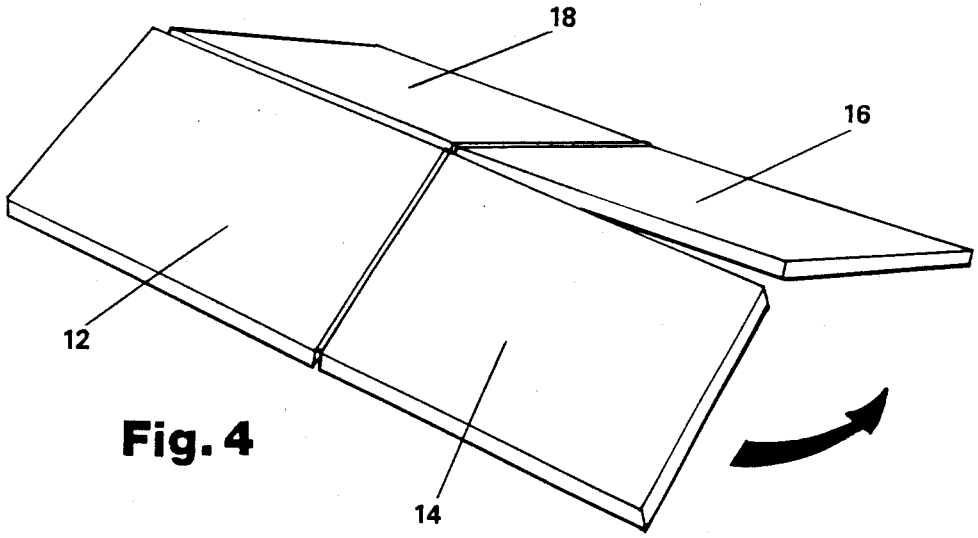
FIG. 4 is a perspective view of the mattress in transition from a fully-open to a longitudinally folded configuration.
Figure 5:
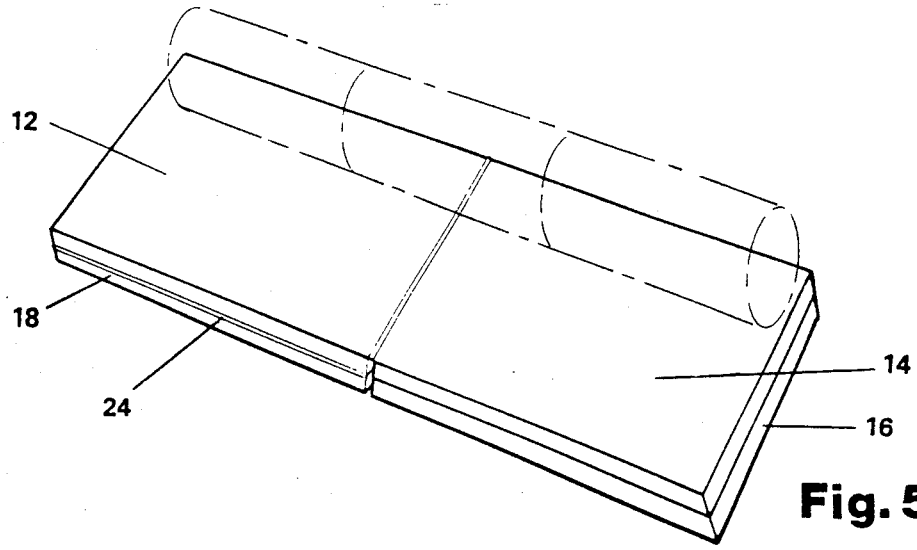
FIG. 5 is a perspective view of the mattress in a longitudinal folded configuration, as it would be used by one person for sleeping, or as a day couch.
Figure 6:
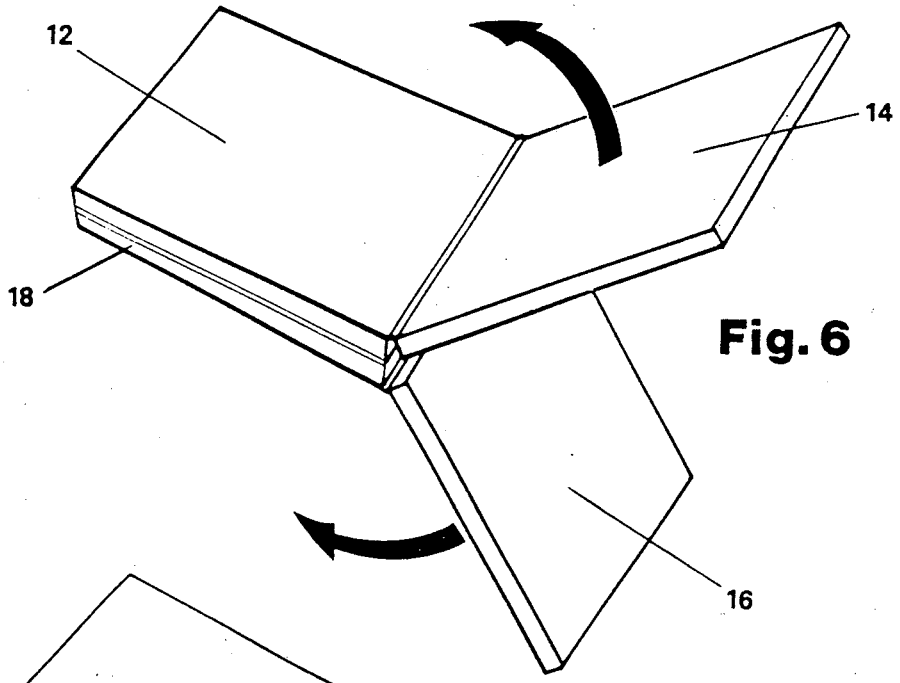
FIG. 6 is a perspective view of the mattress in transition from a longitudinally folded to a fully-folded configuration.
Figure 7:
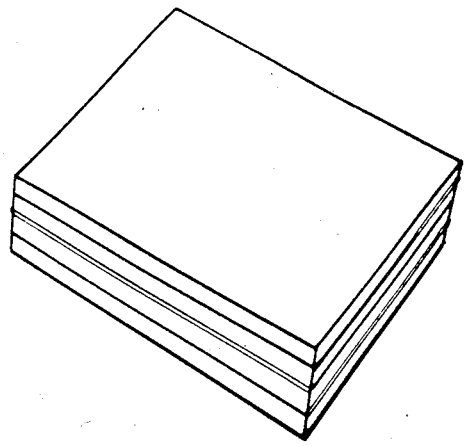
FIG. 7 is a perspective view of the mattress in a fully-folded configuration, as it would be used as an ottoman or for transport and storage.

Now referring to FIGS. 4 and 5, the flexibly hinged convertible mattress is shown respectively in an intermediate position between fully extended and longitudinally folded, and fully longitudinally folded, as it might be used as a single bed or a daytime couch. Note that flexible hinge 24 joins pads 12 and 18, whereas no comparable hinge joins pads 14 and 16. The reason for the later omission is revealed in FIG. 6, where it can be observed that the absence of a bottom-edge hinge joining pads 14 and 16 makes it possible to fold these pads over respectively onto pads 12 and 18, thereby effecting the compact ottoman or easy-to-store module represented in FIG. 7.

Although the description above contains many specificities, these should not be construed as limiting the scope of my invention but as merely providing illustrations of some of its present preferred embodiments and uses. Other embodiments and uses are contemplated, for example, the novel flexibly hinged mattress system I have invented may also be applied to sectional table-tops or table-top pads, portable stage platforms, exhibit display panels, and other diverse and useful purposes.

Thus the scope of the invention should be determined by the appended claims and their legal equivalents, rather than by the examples given.

I claim:

1. A flexibly hinged convertible mattress or other device comprising four approximately rectangular sections of approximately uniform dimensions wherein said first section is flexibly connected to said second section, and said third section is flexibly connected to said fourth section, said flexible connections being made along one like-length top edge of each said section; and also wherein said second section is flexibly connected to said third section, said connection being made along one like-length bottom edge of each of said second and third sections, said flexibly-connected bottom edges being at right angles to said flexibly-connected top-edges, whereby said mattress or other device may be easily and variously folded and unfolded to permit diverse uses and compact storage.

2. The item of claim 1 wherein the sections are fabric-covered foam.

3. The item of claim 2 wherein the foam is closed cell foam.

4. The item of claim 3 where the hinges are fabric hinges.

* * * * *